US008507849B2

(12) United States Patent
Brown

(10) Patent No.: US 8,507,849 B2
(45) Date of Patent: Aug. 13, 2013

(54) MASS SPECTROMETER

(75) Inventor: Jeffery Mark Brown, Cheshire (GB)

(73) Assignee: Micromass UK Limited, Manchester (GB)

( * ) Notice: Subject to any disclaimer, the term of this patent is extended or adjusted under 35 U.S.C. 154(b) by 804 days.

(21) Appl. No.: 11/721,755

(22) PCT Filed: Dec. 19, 2005

(86) PCT No.: PCT/GB2005/004911
§ 371 (c)(1),
(2), (4) Date: Jul. 3, 2009

(87) PCT Pub. No.: WO2006/064280
PCT Pub. Date: Jun. 22, 2006

(65) Prior Publication Data

US 2009/0294642 A1 Dec. 3, 2009

Related U.S. Application Data

(60) Provisional application No. 60/641,960, filed on Jan. 7, 2005.

(30) Foreign Application Priority Data

Dec. 17, 2004 (GB) ..... 0427632.5

(51) Int. Cl.
*H01J 49/40* (2006.01)

(52) U.S. Cl.
USPC ..... 250/287; 250/281; 250/282

(58) Field of Classification Search
USPC ..... 250/281, 282, 283, 287, 288
See application file for complete search history.

(56) References Cited

U.S. PATENT DOCUMENTS

| | | | | |
|---|---|---|---|---|
| 6,300,627 | B1 | 10/2001 | Koster et al. | |
| 6,512,226 | B1 | 1/2003 | Loboda et al. | |
| 6,534,764 | B1 | 3/2003 | Verentchikov et al. | |
| 6,627,877 | B1 | 9/2003 | Davis et al. | |
| 6,900,430 | B2 | 5/2005 | Okumura et al. | |
| 2002/0027194 | A1 * | 3/2002 | Holle et al. | 250/287 |
| 2004/0232327 | A1 | 11/2004 | Bateman et al. | |
| 2005/0242279 | A1 * | 11/2005 | Verentchikov | 250/287 |
| 2007/0034794 | A1 * | 2/2007 | Cotter et al. | 250/287 |

* cited by examiner

FOREIGN PATENT DOCUMENTS

| | | |
|---|---|---|
| EP | 1306881 | 5/2003 |
| WO | 2004021386 | 8/2003 |
| WO | 2004008481 | 1/2004 |

OTHER PUBLICATIONS

Bateman, R. H. et al; A Combined Magnetic Sector-Time-of-flight Mass Spectrometer for Structural Determination Studies by Tandem Mass Spectrometry; Rapid Communications in Mass Spectrometry, vol. 9, 1227-1233 (1995).

*Primary Examiner* — Nicole Ippolito
(74) *Attorney, Agent, or Firm* — Diederiks & Whitelaw, PLC

(57) ABSTRACT

A mass spectrometer is disclosed comprising a MALDI ion source coupled to an orthogonal acceleration Time of Flight mass analyzer. The mass spectrometer is operated at a first instrument setting wherein specific parent ions are selected by a mass filter and are accelerated to a first axial energy. The fragment ions are then orthogonally accelerated after a first delay time and first mass spectral data is obtained. The mass spectrometer is then operated at a second instrument setting wherein the axial energy of the parent ions is increased and the resulting fragment ions are orthogonally accelerated after a reduced delay time. Second mass spectral data is then obtained. The first and second mass spectral data are then combined to provided a final composite mass spectrum.

34 Claims, 3 Drawing Sheets

MASS SPECTROMETER

CROSS REFERENCE TO RELATED APPLICATIONS

This application is the National Stage of International Application No. PCT/GB2005/004911, filed on Dec. 19, 2005, which claims priority to and benefit of U.S. Provisional Patent Application Ser. No. 60/641,960, filed on Jan. 7, 2005, and priority to and benefit of United Kingdom Patent Application No. 0427632, filed Dec. 17, 2004. The entire contents of these applications are incorporated herein by reference.

BACKGROUND OF THE INVENTION

The present invention relates to a mass spectrometer and a method of mass spectrometry.

A known mass spectrometer comprises a Matrix Assisted Laser Desorption Ionisation ("MALDI") ion source coupled to an orthogonal acceleration Time of Flight mass analyser. Ions are orthogonally accelerated in the mass analyser and the time of flight of the ions is measured. This enables the mass to charge ratio of the ions to be determined. Orthogonal acceleration Time of Flight mass analysers are particularly advantageous compared to axial or in-line Time of Flight mass analysers when coupled to a MALDI ion source in that the resolution, mass calibration and mass accuracy of an orthogonal acceleration Time of Flight mass analyser is substantially unaffected by variations in ion desorption velocities from the MALDI ion source.

A further advantage of using an orthogonal acceleration Time of Flight mass analyser in combination with a MALDI ion source is that variations in the sample thickness or the surface potential applied to the MALDI target plate do not directly affect the subsequent time of flight of ions in the flight or drift region of the orthogonal acceleration Time of Flight mass analyser.

Two different types of instrument are known. The first type of instrument utilises a radio frequency collisional cooling gas cell that lowers the axial and orthogonal kinetic energy of the ions to levels appropriate for the orthogonal acceleration Time of Flight mass analyser. These instruments are more complex, more expensive, and less efficient compared to in-line or axial MALDI mass spectrometers comprising a Time of Flight mass analyser. The cooling gas may promote matrix cluster formation that increases chemical background and reduces signal to noise. The second type of instrument does not employ gaseous collisional damping and as such the higher precursor ion kinetic energies permit the recording of high energy collision induced dissociation (CID) MS/MS fragmentation mass spectra. Ions are allowed to retain their axial velocities and the detector of the orthogonal acceleration Time of Flight mass analyser has to be larger in order to cope with the larger angular spread of ions caused by the large axial energy spread. One example of the second type of instrument is a hybrid magnetic sector orthogonal acceleration Time of Flight tandem MS/MS instrument (Bateman et al., Rapid Commun. Mass Spectrom. 9 (1995) 1227). The instrument comprises a MALDI ion source, a magnetic sector mass filter for high resolution selection of precursor ions, a collision induced dissociation (CID) gas cell and an orthogonal acceleration Time of Flight mass analyser for recording the fragment or daughter ions generated in the gas cell.

In this instrument fragment or daughter ions retain the original parent or precursor ion velocity, as such, their kinetic energy is proportional to their mass. When a parent or precursor ion and its associated fragment or daughter ions reach the orthogonal acceleration Time of Flight mass analyser the ions are accelerated through a constant electric field from the pusher region into the orthogonal acceleration Time of Flight flight tube.

Conventional mass spectrometers of the second type of instrument described above which comprise a MALDI ion source coupled to an orthogonal acceleration Time of Flight mass analyser suffer from the problem that ions arriving at the orthogonal acceleration region of the mass analyser will have a wide range of axial energies. Accordingly, when the ions are orthogonally accelerated the ion detector is only able to detect and record ions having a relatively narrow or small range of mass or mass to charge ratios. Since the orthogonal flight or path length of ions in the mass analyser is limited and since the ion detector is constrained in size then these factors (as will be discussed in more detail below) place a limitation on the range of mass or mass to charge ratios of ions which can both be orthogonally accelerated and also subsequently detected by the ion detector of the mass analyser.

It is therefore desired to provide an improved mass spectrometer and an improved method of mass spectrometry.

SUMMARY OF THE INVENTION

According to an aspect of the present invention there is provided a method of mass spectrometry comprising:

providing an orthogonal acceleration Time of Flight mass analyser comprising an orthogonal acceleration region;

providing a first packet or group of parent or precursor ions;

accelerating the first packet or group of parent or precursor ions so that the first packet or group of parent or precursor ions possess a first axial energy;

fragmenting the first packet or group of parent or precursor ions into a first plurality of fragment or daughter ions or allowing the first packet or group of parent or precursor ions to fragment into a first plurality of fragment or daughter ions;

orthogonally accelerating at least some of the first plurality of fragment or daughter ions after a first delay time;

detecting fragment or daughter ions of the first plurality of fragment or daughter ions having a first range of axial energies;

generating first mass spectral data relating to fragment or daughter ions of the first plurality of fragment or daughter ions having the first range of axial energies;

providing a second packet or group of parent or precursor ions;

accelerating the second packet or group of parent or precursor ions so that the second packet or group of parent or precursor ions possess a second different axial energy;

fragmenting the second packet or group of parent or precursor ions into a second plurality of fragment or daughter ions or allowing the second packet or group of parent or precursor ions to fragment into a second plurality of fragment or daughter ions;

orthogonally accelerating at least some of the second plurality of fragment or daughter ions after a second delay time;

detecting fragment or daughter ions of the second plurality of fragment or daughter ions having a second range of axial energies;

generating second mass spectral data relating to the fragment or daughter ions of the second plurality of fragment or daughter ions having the second range of axial energies; and forming a composite mass spectrum by using, combining or overlapping the first mass spectral data and the second mass spectral data.

The delay time is preferably the difference in time between a parent or precursor ions being generated, for example, by firing a laser at a MALDI target plate and a pusher electrode arranged adjacent an orthogonal acceleration region of a Time of Flight mass analyser being energised in order to orthogonally accelerate ions into the drift or flight region of the Time of Flight mass analyser.

The first range of axial energies is preferably substantially the same as the second range of axial energies.

The first delay time is preferably substantially different to the second delay time.

According to the preferred embodiment there is preferably provided a first electric field region and a first field free region. Preferably, the first field free region is arranged downstream of the first electric field region.

A second electric field region is preferably provided and a second field free region is preferably provided. The second field free region is preferably arranged downstream of the second electric field region.

One or more electrodes are preferably arranged adjacent the orthogonal acceleration region.

The step of accelerating the first packet or group of parent or precursor ions preferably comprises maintaining the first electric field and/or the first field free region and/or the second electric field and/or the second field free region and/or the one or more electrodes at a first electric field strength, voltage or potential, or voltage or potential difference. The step of accelerating the second packet or group of parent or precursor ions preferably comprises maintaining the first electric field and/or the first field free region and/or the second electric field and/or the second field free region and/or the one or more electrodes at a second electric field strength, voltage or potential, or voltage or potential difference. The second electric field strength, voltage or potential, or voltage or potential difference differs from the first electric field strength, voltage or potential, or voltage or potential difference by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

According to an embodiment the first axial energy is selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The first axial energy may be selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii) 2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The first delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100 μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

At least some of the first plurality of fragment or daughter ions are preferably orthogonally accelerated so that the at least some of the first plurality of fragment or daughter ions possess a first orthogonal energy. The first orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The second axial energy is preferably selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The second axial energy is preferably selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii) 2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The second delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100, μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

The at least some of the second plurality of fragment or daughter ions are preferably orthogonally accelerated so that the at least some of the second plurality of fragment or daughter ions possess a second orthogonal energy. The second orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

According to the preferred embodiment, the method preferably further comprises:

providing a third packet or group of parent or precursor ions;

accelerating the third packet or group of parent or precursor ions so that the third packet or group of parent or precursor ions possess a third different axial energy;

fragmenting the third packet or group of parent or precursor ions into a third plurality of fragment or daughter ions or allowing the third packet or group of parent or precursor ions to fragment into a third plurality of fragment or daughter ions;

orthogonally accelerating at least some of the third plurality of fragment or daughter ions after a third delay time;

detecting fragment or daughter ions of the third plurality of fragment or daughter ions having a third range of axial energies; and generating third mass spectral data relating to fragment of daughter ions of the third plurality of fragment or daughter ions having the third range of axial energies.

The first, second and third ranges of axial energies are preferably substantially the same. The first, second and third delay times are preferably substantially different. The step of accelerating the third packet or group of parent or precursor ions preferably comprises maintaining the first electric field and/or the first field free region and/or the second electric field and/or the second field free region and/or the one or more electrodes at a third electric field strength, voltage or potential, or voltage or potential difference. The third electric field strength, voltage or potential, or voltage or potential difference preferably differs from the first and/or second electric field strength, voltage or potential, or voltage or potential difference by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

The third axial energy is preferably selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The third axial energy is preferably selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii) 2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The third delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100 μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

The at least some of the third plurality of fragment or daughter ions are preferably orthogonally accelerated so that the at least some of the third plurality of fragment or daughter ions possess a third orthogonal energy. The third orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The step of forming a composite mass spectrum preferably further comprises using, combining or overlapping the first mass spectral data, the second mass spectral data and the third mass spectral data.

The method preferably further comprises:

providing a fourth packet or group of parent or precursor ions;

accelerating the fourth packet or group of parent or precursor ions so that the fourth packet or group of parent or precursor ions possess a fourth different axial energy;

fragmenting the fourth packet or group of parent or precursor ions into a fourth plurality of fragment or daughter ions or allowing the fourth packet or group of parent or precursor ions to fragment into a fourth plurality of fragment or daughter ions;

orthogonally accelerating at least some of the fourth plurality of fragment or daughter ions after a fourth delay time;

detecting fragment or daughter ions of the fourth plurality of fragment or daughter ions having a fourth range of axial energies; and generating fourth mass spectral data relating to fragment of daughter ions of the fourth plurality of fragment or daughter ions having the fourth range of axial energies.

The first, second, third and fourth ranges of axial energies are preferably substantially the same. The first, second, third and fourth delay times are preferably substantially different.

The step of accelerating the fourth packet or group of parent or precursor ions preferably comprises maintaining the first electric field and/or the first field free region and/or the second electric field and/or the second field free region and/or the one or more electrodes at a fourth electric field strength, voltage or potential, or voltage or potential difference.

The fourth electric field strength, voltage or potential, or voltage or potential difference preferably differs from the first and/or second and/or third electric field strength, voltage or potential, or voltage or potential difference by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

The fourth axial energy is preferably selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The fourth axial energy may be selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii) 2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The fourth delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100 μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

The at least some of the fourth plurality of fragment or daughter ions are preferably orthogonally accelerated so that the at least some of the fourth plurality of fragment or daughter ions possess a fourth orthogonal energy. The fourth orthogonal energy is selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The step of forming a composite mass spectrum preferably further comprises using, combining or overlapping the first mass spectral data, the second mass spectral data, the third mass spectral data and the fourth mass spectral data.

The method preferably further comprises:

providing a fifth packet or group of parent or precursor ions;

accelerating the fifth packet or group of parent or precursor ions so that the fifth packet or group of parent or precursor ions possess a fifth different axial energy;

fragmenting the fifth packet or group of parent or precursor ions into a fifth plurality of fragment or daughter ions or allowing the fifth packet or group of parent or precursor ions to fragment into a fifth plurality of fragment or daughter ions;

orthogonally accelerating at least some of the fifth plurality of fragment or daughter ions after a fifth delay time;

detecting fragment or daughter ions of the fifth plurality of fragment or daughter ions having a fifth range of axial energies; and generating fifth mass spectral data relating to fragment of daughter ions of the fifth plurality of fragment or daughter ions having the fifth range of axial energies.

The first, second, third, fourth and fifth ranges of axial energies are preferably substantially the same. The first, second, third, fourth and fifth delay times are preferably substantially different.

The step of accelerating the fifth packet or group of parent or precursor ions preferably comprises maintaining the first electric field and/or the first field free region and/or the second electric field and/or the second field free region and/or the one or more electrodes at a fifth electric field strength, voltage or potential, or voltage or potential difference.

The fifth electric field strength, voltage or potential, or voltage or potential difference preferably differs from the first and/or second and/or third and/or fourth electric field strength, voltage or potential, or voltage or potential difference by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

The fifth axial energy is preferably selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The fifth axial energy is preferably selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii)

2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The fifth delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100 μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

The at least some of the fifth plurality of fragment or daughter ions are preferably orthogonally accelerated so that the at least some of the fifth plurality of fragment or daughter ions possess a fifth orthogonal energy. The fifth orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The step of forming a composite mass spectrum preferably further comprises using, combining or overlapping the first mass spectral data, the second mass spectral data, the third mass spectral data, the fourth mass spectral data and the fifth mass spectral data.

The method preferably further comprises:

providing a sixth packet or group of parent or precursor ions;

accelerating the sixth packet or group of parent or precursor ions so that the sixth packet or group of parent or precursor ions possess a sixth different axial energy;

fragmenting the sixth packet or group of parent or precursor ions into a sixth plurality of fragment or daughter ions or allowing the sixth packet or group of parent or precursor ions to fragment into a sixth plurality of fragment or daughter ions;

orthogonally accelerating at least some of the sixth plurality of fragment or daughter ions after a sixth delay time;

detecting fragment or daughter ions of the sixth plurality of fragment or daughter ions having a sixth range of axial energies; and generating sixth mass spectral data relating to fragment of daughter ions of sixth plurality of fragment or daughter ions having the sixth range of axial energies.

The first, second, third, fourth, fifth and sixth ranges of axial energies are preferably substantially the same. The first, second, third, fourth, fifth and sixth delay times are preferably substantially different.

The step of accelerating the sixth packet or group of parent or precursor ions preferably comprises maintaining the first electric field and/or the first field free region and/or the second electric field and/or the second field free region and/or the one or more electrodes at a sixth electric field strength, voltage or potential, or voltage or potential difference.

The sixth electric field strength, voltage or potential preferably differs from the first and/or second and/or third and/or fourth and/or fifth electric field strength, voltage or potential, or voltage or potential difference by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

The sixth axial energy is preferably selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The sixth axial energy is preferably selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii) 2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The sixth delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100 μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

The at least some of the sixth plurality of fragment or daughter ions are preferably orthogonally accelerated so that the at least some of the sixth plurality of fragment or daughter ions possess a sixth orthogonal energy. The sixth orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-

17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The step of forming a composite mass spectrum preferably further comprises using, combining or overlapping the first mass spectral data, the second mass spectral data, the third mass spectral data, the fourth mass spectral data, the fifth mass spectral data and the sixth mass spectral data.

According to an embodiment the first axial energy and/or the second axial energy and/or the third axial energy and/or the fourth axial energy and/or the fifth axial energy and/or the sixth axial energy are preferably substantially different from one another. According to an embodiment the first delay time and/or the second delay time and/or the third delay time and/or the fourth delay time and/or the fifth delay time and/or the sixth delay time are preferably substantially different from one another. According to an embodiment the first orthogonal energy and/or the second orthogonal energy and/or the third orthogonal energy and/or the fourth orthogonal energy and/or the fifth orthogonal energy and/or the sixth orthogonal energy are preferably substantially the same.

The method preferably further comprises providing a collision, fragmentation or reaction device.

The collision, fragmentation or reaction device is preferably arranged to fragment ions by Collisional Induced Dissociation ("CID").

According to an alternative embodiment the collision, fragmentation or reaction device is selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

A reaction device should be understood as comprising a device wherein ions, atoms or molecules are rearranged or reacted so as to form a new species of ion, atom or molecule. An X-Y reaction fragmentation device should be understood as meaning a device wherein X and Y combine to form a product which then fragments. This is different to a fragmentation device per se wherein ions may be caused to fragment without first forming a product. An X-Y reaction device should be understood as meaning a device wherein X and Y combine to form a product and wherein the product does not necessarily then fragment.

The step of allowing ions to fragment preferably comprises allowing ions to fragment by Post Source Decay ("PSD")

The method preferably further comprises providing an electrostatic energy analyser and/or a mass filter and/or an ion gate for selecting specific parent or precursor ions. The mass filter preferably comprises a magnetic sector mass filter, an RF quadrupole mass filter, a Wien filter or an orthogonal acceleration Time of Flight mass filter.

According to another aspect of the present invention there is provided a mass spectrometer comprising:

an orthogonal acceleration Time of Flight mass analyser comprising an orthogonal acceleration region;

a control system which is arranged to:

(i) accelerate a first packet or group of parent or precursor ions so that the first packet or group of parent or precursor ions possesses a first axial energy;

(ii) fragment the first packet or group of parent or precursor ions into a first plurality of fragment or daughter ions or allow the first packet or group of parent or precursor ions to fragment into a first plurality of fragment or daughter ions;

(iii) orthogonally accelerate at least some of the first plurality of fragment or daughter ions after a first delay time;

(iv) accelerate a second packet or group of parent or precursor ions so that the second packet or group of parent or precursor ions possesses a second different axial energy;

(v) fragment the second packet or group of parent or precursor ions into a second plurality of fragment or daughter ions or allowing the second packet or group of parent or precursor ions to fragment into a second plurality of fragment or daughter ions; and (vi) orthogonally accelerate at least some of the second plurality of fragment or daughter ions after a second delay time;

an ion detector which is arranged to:

(i) detect fragment or daughter ions of the first plurality of fragment or daughter ions having a first range of axial energies;

(ii) detect fragment or daughter ions of the second plurality of fragment or daughter ions having a second range of axial energies;

the mass spectrometer further comprising:

means arranged to generate first mass spectral data relating to fragment or daughter ions of the first plurality of fragment or daughter ions having the first range of axial energies;

means arranged to generate second mass spectral data relating to the fragment or daughter ions of the second plurality of fragment or daughter ions having the second range of axial energies; and means arranged to form a composite mass spectrum by using, combining or overlapping the first mass spectral data and the second mass spectral data.

The first range of axial energies is preferably substantially the same as the second range of axial energies.

The first delay time is preferably substantially different to the second delay time.

The mass spectrometer preferably further comprises a first electric field region and a first field free region. The first field free region is preferably arranged downstream of the first electric field region.

The mass spectrometer preferably further comprises a second electric field region and a second field free region. The second field free region is preferably arranged downstream of the second electric field region.

The mass spectrometer preferably further comprises one or more electrodes arranged adjacent the orthogonal acceleration region.

The control system is preferably arranged to maintain the first electric field and/or the first field free region and/or the second electric field and/or the second field free region and/or the one or more electrodes at a first electric field strength, voltage or potential, or voltage or potential difference in order to accelerate the first packet or group of parent or precursor ions.

The control system is preferably arranged to maintain the first electric field and/or the first field free region and/or the second electric field and/or the second field free region and/or the one or more electrodes at a second electric field strength, voltage or potential, or voltage or potential difference in order to accelerate the second packet or group of parent or precursor ions.

The second electric field strength, voltage or potential, or voltage or potential difference preferably differs from the first electric field strength, voltage or potential, or voltage or potential difference by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

The first axial energy is preferably selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The first axial energy is preferably selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii) 2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The first delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100 μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

The at least some of the first plurality of fragment or daughter ions are preferably orthogonally accelerated so that the at least some of the first plurality of fragment or daughter ions possess a first orthogonal energy. The first orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The second axial energy is preferably selected from the group consisting of: (i) <20 eV; (ii) 20-40 eV; (iii) 40-60 eV; (iv) 60-80 eV; (v) 80-100 eV; (vi) 100-120 eV; (vii) 120-140 eV; (viii) 140-160 eV; (ix) 160-180 eV; (x) 180-200 eV; (xi) 200-220 eV; (xii) 220-240 eV; (xiii) 240-260 eV; (xiv) 260-280 eV; (xv) 280-300 eV; (xvi) 300-320 eV; (xvii) 320-340 eV; (xviii) 340-360 eV; (xix) 360-380 eV; (xx) 380-400 eV; (xxi) 400-420 eV; (xxii) 420-440 eV; (xxiii) 440-460 eV; (xxiv) 460-480 eV; (xxv) 480-500 eV; (xxvi) 500-550 eV; (xxvii) 550-600 eV; (xxviii) 600-650 eV; (xxix) 650-700 eV; (xxx) 700-750 eV; (xxxi) 750-800 eV; (xxxii) 800-850 eV; (xxxiii) 850-900 eV; (xxxiv) 900-950 eV; (xxxv) 950-1000 eV; and (xxxvi) >1 keV.

The second axial energy is preferably selected from the group consisting of: (i) 1.0-1.2 keV; (ii) 1.2-1.4 keV; (iii) 1.4-1.6 keV; (iv) 1.6-1.8 keV; (v) 1.8-2.0 keV; (vi) 2.0-2.2 keV; (vii) 2.2-2.4 keV; (viii) 2.4-2.6 keV; (ix) 2.6-2.8 keV; (x) 2.8-3.0 keV; (xi) 3.0-3.2 keV; (xii) 3.2-3.4 keV; (xiii) 3.4-3.6 keV; (xiv) 3.6-3.8 keV; (xv) 3.8-4.0 keV; (xvi) 4.0-4.2 keV; (xvii) 4.2-4.4 keV; (xviii) 4.4-4.6 keV; (xix) 4.6-4.8 keV; (xx) 4.8-5.0 keV; (xxi) 5.0-5.5 keV; (xxii) 5.5-6.0 keV; (xxiii) 6.0-6.5 keV; (xxiv) 6.5-7.0 keV; (xxv) 7.0-7.5 keV; (xxvi) 7.5-8.0 keV; (xxvii) 8.0-8.5 keV; (xxviii) 8.5-9.0 keV; (xxix) 9.0-9.5 keV; (xxx) 9.5-10.0 keV; and (xxxi) >10 keV.

The second delay time is preferably selected from the group consisting of: (i) <1 μs; (ii) 1-5 μs; (iii) 5-10 μs; (iv) 10-15 μs; (v) 15-20 μs; (vi) 20-25 μs; (vii) 25-30 μs; (viii) 30-35 μs; (ix) 35-40 μs; (x) 40-45 μs; (xi) 45-50 μs; (xii) 50-55 μs; (xiii) 55-60 μs; (xiv) 60-65 μs; (xv) 65-70 μs; (xvi) 70-75 μs; (xvii) 75-80 μs; (xviii) 80-85 μs; (xix) 85-90 μs; (xx) 90-95 μs; (xxi) 95-100 μs; (xxii) 100-100 μs; (xxiii) 110-120 μs; (xxiv) 120-130 μs; (xxv) 130-140 μs; (xxvi) 140-150 μs; (xxvii) 150-160 μs; (xxviii) 160-170 μs; (xxix) 170-180 μs; (xxx) 180-190 μs; (xxxi) 190-200 μs; (xxxii) 200-250 μs; (xxxiii) 250-300 μs; (xxxiv) 300-350 μs; (xxxv) 350-400 μs; (xxxvi) 400-450 μs; (xxxvii) 450-500 μs; (xxxviii) 500-1000 μs; and (xxxix) >1000 μs.

The at least some of the second plurality of fragment or daughter ions are preferably orthogonally accelerated so that the at least some of the second plurality of fragment or daughter ions possess a second orthogonal energy. The second orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv)

17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source may comprise a continuous or pulsed ion source.

The mass spectrometer preferably further comprises a collision, fragmentation or reaction device.

The collision, fragmentation or reaction device may be arranged to fragment ions by Collisional Induced Dissociation ("CID").

Alternatively, the collision, fragmentation or reaction device may be selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

At least some parent or precursor ions are preferably fragmented or reacted in use in the collision, fragmentation or reaction device to form fragment, daughter, adduct or product ions and wherein the fragment, daughter, adduct or product ions and/or any corresponding parent or precursor ions exit the collision, fragmentation or reaction device with substantially the same velocity and reach the orthogonal acceleration region at substantially the same time.

The mass spectrometer may comprise means arranged to cause and/or allow ions to fragment by Post Source Decay ("PSD").

The mass spectrometer may further comprise an electrostatic energy analyser and/or a mass filter and/or an ion gate for selecting specific parent or precursor ions. The mass filter may comprise a magnetic sector mass filter, an RF quadrupole mass filter, a Wien filter or an orthogonal acceleration Time of Flight mass filter.

According to another aspect of the present invention there is provided a method of mass spectrometry comprising:

providing an orthogonal acceleration Time of Flight mass analyser comprising an orthogonal acceleration region;

providing a first packet or group of parent or precursor ions;

fragmenting the first packet or group of parent or precursor ions into a first plurality of fragment or daughter ions or allowing the first packet or group of parent or precursor ions to fragment into a first plurality of fragment or daughter ions;

orthogonally accelerating at least some of the first plurality of fragment or daughter ions so that the at least some of the first plurality of fragment or daughter ions possess a first orthogonal energy;

detecting fragment or daughter ions of the first plurality of fragment or daughter ions having the first orthogonal energy;

generating first mass spectral data relating to fragment or daughter ions of the first plurality of fragment or daughter ions having the first orthogonal energy;

providing a second packet or group of parent or precursor ions;

fragmenting the second packet or group of parent or precursor ions into a second plurality of fragment or daughter ions or allowing the second packet or group of parent or precursor ions to fragment into a second plurality of fragment or daughter ions;

orthogonally accelerating at least some of the second plurality of fragment or daughter ions so that the at least some of the second plurality of fragment or daughter ions possess a second different orthogonal energy;

detecting fragment or daughter ions of the second plurality of fragment or daughter ions having the second orthogonal energy;

generating second mass spectral data relating to the fragment or daughter ions of the second plurality of fragment or daughter ions having the second orthogonal energy; and forming a composite mass spectrum by using, combining or overlapping the first mass spectral data and the second mass spectral data.

The first orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

The second orthogonal energy is preferably selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

According to another aspect of the present invention there is provided a mass spectrometer comprising:

an orthogonal acceleration Time of Flight mass analyser comprising an orthogonal acceleration region;

a control system which is arranged to:

(i) fragment a first packet or group of parent or precursor ions into a first plurality of fragment or daughter ions or allow the first packet or group of parent or precursor ions to fragment into a first plurality of fragment or daughter ions;

(ii) orthogonally accelerate at least some of the first plurality of fragment or daughter ions so that the at least some of the first plurality of fragment or daughter ions possess a first orthogonal energy;

(iii) fragment a second packet or group of parent or precursor ions into a second plurality of fragment or daughter ions or allow the second packet or group of parent or precursor ions to fragment into a second plurality of fragment or daughter ions; and (iv) orthogonally accelerate at least some of the second plurality of fragment or daughter ions so that the at least some of the second plurality of fragment or daughter ions possess a second different orthogonal energy;

an ion detector which is arranged to:

(i) detect fragment or daughter ions of the first plurality of fragment or daughter ions having the first orthogonal energy;

(ii) detect fragment or daughter ions of the second plurality of fragment or daughter ions having the second orthogonal energy;

the mass spectrometer further comprising:

means arranged to generate first mass spectral data relating to fragment or daughter ions of the first plurality of fragment or daughter ions having the first orthogonal energy;

means arranged to generate second mass spectral data relating to the fragment or daughter ions of the second plurality of fragment or daughter ions having the second orthogonal energy; and means arranged to form a composite mass spectrum by using, combining or overlapping the first mass spectral data and the second mass spectral data.

The preferred embodiment enables mass spectral data relating to fragment or daughter ions having a wide range of mass or mass to charge ratios to be obtained without needing to increase the size or length of the ion detector. According to the preferred embodiment the axial kinetic energy of parent or precursor ions is preferably progressively increased in a series of separate steps at a plurality of separate instrument settings. The delay time between generating a pulse of ions by firing the laser and orthogonally accelerating ions into the flight or drift region of the orthogonal acceleration Time of Flight mass analyser (by applying a voltage to a pusher electrode arranged adjacent the orthogonal acceleration region) is also preferably progressively decreased at each step or subsequent instrument setting.

According to the preferred embodiment fragment or daughter ions having mass or mass to charge ratios within a certain range are preferably arranged to possess appropriate energies such that they will follow trajectories through the flight or drift region of the mass analyser and end up being detected by the ion detector. The mass spectrometer is then preferably operated at second and further instrument settings and fragment or daughter ions having different masses or mass to charge ratios are preferably arranged to possess appropriate energies such that they will follow trajectories through the flight or drift region of the mass analyser and end up being detected by the ion detector. A final composite mass spectrum is preferably produced by combining mass spectral data obtained at each of the various instrument settings.

BRIEF DESCRIPTION OF THE DRAWINGS

Various embodiments of the present invention together with other arrangements given for illustrative purposes only will now be described, by way of example only, and with reference to the accompanying drawings in which.

DETAILED DESCRIPTION OF THE PREFERRED EMBODIMENTS

Figure 1:
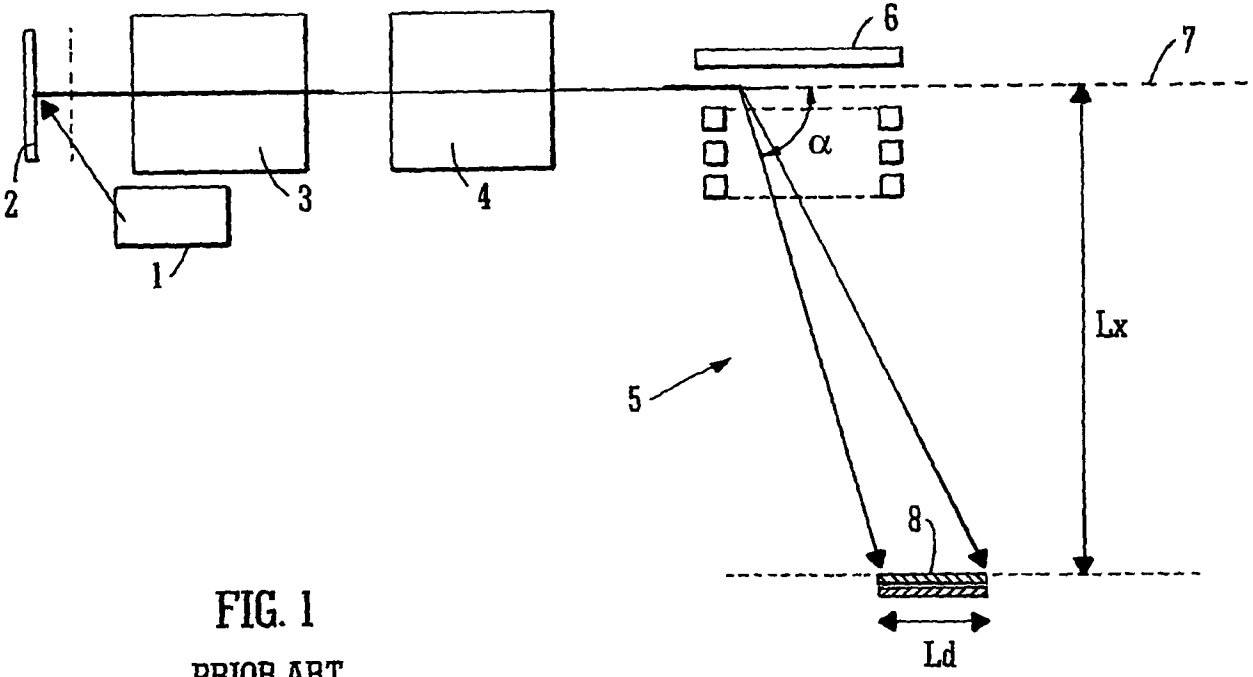
FIG. 1 PRIOR ART
FIG. 1 shows a conventional mass spectrometer comprising a MALDI ion source coupled to an orthogonal acceleration Time of Flight mass analyser wherein the mass spectrometer further comprises a magnetic sector mass filter and a collision cell for fragmenting ions.

A known mass spectrometer is shown in FIG. 1. The known mass spectrometer comprises a MALDI ion source comprising a target plate 2 and laser 1. The laser 1 is arranged to emit a pulsed laser beam which is arranged to impinge upon the target plate 2. The laser pulse causes ions to be desorbed from the target plate 2.

The MALDI ion source generates a pulse of ions which is then transmitted to a magnetic sector mass filter 3 which is arranged downstream of the ion source. The magnetic sector mass filter 3 comprises a high resolution mass filter which is arranged to mass filter parent or precursor ions emitted from the ion source such that only parent or precursor ions having a specific mass to charge ratio are onwardly transmitted by the mass filter 3.

The specific parent or precursor ions which are onwardly transmitted by the mass filter 3 are then arranged to enter a Collision Induced Dissociation ("CID") gas cell 4 arranged downstream of the magnetic sector mass filter 3. The parent or precursor ions which are transmitted by the mass filter 3 are arranged to be fragmented in the gas cell 4 such that a plurality of fragment or daughter ions are produced. The resulting fragment or daughter ions are then arranged to pass from the gas cell 4 to an orthogonal acceleration region of an orthogonal acceleration Time of Flight mass analyser 5. The orthogonal acceleration Time of Flight mass analyser 5 is arranged downstream of the gas cell 4.

The orthogonal acceleration Time of Flight mass analyser 5 comprises a pusher electrode 6 which is arranged adjacent the orthogonal acceleration region. Ions are arranged to initially enter the mass analyser 5 along an axis 7 which passes through the orthogonal acceleration region. The axis 7 is also parallel to the plane of the pusher electrode 6. The pusher electrode 6 is periodically energised by applying a voltage to the pusher electrode 6. The application of a voltage pulse to the pusher electrode 6 causes an electric field in a direction orthogonal to the axis 7 to be generated. The orthogonal electric field orthogonally accelerates ions present in the orthogonal acceleration region into a flight or drift region of the mass analyser 5. The flight or drift region comprises a field free region and ions passing through the flight or drift region are arranged to become temporally separated according to their mass to charge ratio.

An ion detector 8 comprising a microchannel plate detector is arranged at the end of the flight or drift region and is arranged to detect ions as they arrive having passed through the flight or drift region. The ion detector 8 is also arranged to measure the arrival time of the ions at the ion detector 8. The mass to charge ratio of the ions can then be derived from the time of flight taken for the ions to pass through the flight or drift region of the mass analyser 5.

In a mode of operation the orthogonal acceleration Time of Flight mass analyser 5 is arranged to record the mass to charge ratios of some of the fragment or daughter ions which have been produced in the gas cell 4. However, because of the limited size of the ion detector 8, the ion detector 8 is only able to detect fragment or daughter ions having a relatively small range of masses or mass to charge ratios.

The fragment or daughter ions produced in the gas cell 4 will retain essentially the same velocity as the parent or precursor ions from which they were derived. The kinetic energy of the fragment or daughter ions will therefore be proportional to the mass or mass to charge ratio of the ion.

In order to detect all fragment of daughter ions produced in the gas cell 4 the ion detector 8 would need to be very large or wide since the ions which are orthogonally accelerated into the flight or drift region of the mass analyser 5 will travel along different trajectories which will have a large angular spread. The large angular spread is due to the fact that the fragment or daughter ions which are orthogonally accelerated into the flight or drift region of the mass analyser 5 will have a large spread of axial kinetic energies.

It can be seen from the following equation that fragment or daughter ions which are orthogonally accelerated into the flight or drift region of the mass analyser 5 will follow trajectories which will make a wide range of different angles $\alpha$ with respect to the axis 7 along which ions initially entered the mass analyser 5. The angle $\alpha$ between the trajectory of a fragment or daughter ion through the flight or drift region of the mass analyser 5 and the axis 7 is shown in FIG. 1 and can be derived from the following relationship:

$$\tan(\alpha) = \sqrt{\frac{MpEx}{MdEo}} \tag{1}$$

wherein Mp is the mass or mass to charge ratio of a certain parent or precursor ion, Md is the mass or mass to charge ratio of a fragment or daughter ion which is derived from the parent or precursor ion, Eo is the maximum axial ion energy that an ion may possess and be detected by the ion detector and Ex is the orthogonal energy imparted to ions as they are orthogonally accelerated into the flight or drift region of the mass analyser.

If Md is assumed to be the lowest mass or mass to charge ratio fragment or daughter ion which can be detected by an ion detector 8 having a limited length or width, then the length or width Ld of the ion detector 8 is given by:

$$Ld = Lx\sqrt{\frac{Eo}{Ex}} \cdot \left(1 - \sqrt{\frac{Md}{Mp}}\right) \tag{2}$$

wherein Lx is the effective orthogonal flight or path length, Eo is the maximum axial ion energy that an ion may possess and be detected by the ion detector and Ex is the orthogonal energy imparted to ions as they are orthogonally accelerated into the flight or drift region of the mass analyser.

It is apparent that the physical length or width Ld of the ion detector 8 determines the lowest mass or mass to charge ratio ion which can be detected by the ion detector 8. Accordingly, it will be appreciated that the known mass spectrometer is only able to produce a mass spectrum of ions having a relatively narrow or restricted range of mass or mass to charge ratios.

The orthogonal flight or path length Lx is an important parameter that may be maximised in order to increase mass resolution. However, if the orthogonal flight or path length Lx is increased then the length of the ion detector 8 also needs to be increased. However, it is not practically possible to continue increasing the size or length of the ion detector 8 beyond a certain practical limit. It will be appreciated that the cost of an ion detector 8 increases in proportion to the size or length of the ion detector 8. Furthermore, if the size or length Ld of the ion detector 8 is increased then it also becomes significantly more difficult to maintain the necessary flatness tolerance for high mass resolution. Furthermore, if the length of the ion detector 8 were extended so that the ion detector 8 was able to detect relatively low mass or mass to charge ratio ions, then the lower kinetic energies which such ions would possess is such that the ions will be more susceptible to deflection or defocusing effects due to electrostatic imperfections such as those resulting from unwanted surface charging effects. These effects can reduce the ion transmission of low energy ions and adversely effect sensitivity.

It will be appreciated therefore that the known mass spectrometer suffers from the problem that it is only possible to mass analyse a relatively small proportion of the fragment or daughter ions which may be produced in the gas or collision cell 4 and that it is not practical to attempt to solve this problem simply by making the ion detector 8 larger, wider or longer.

Figure 2:
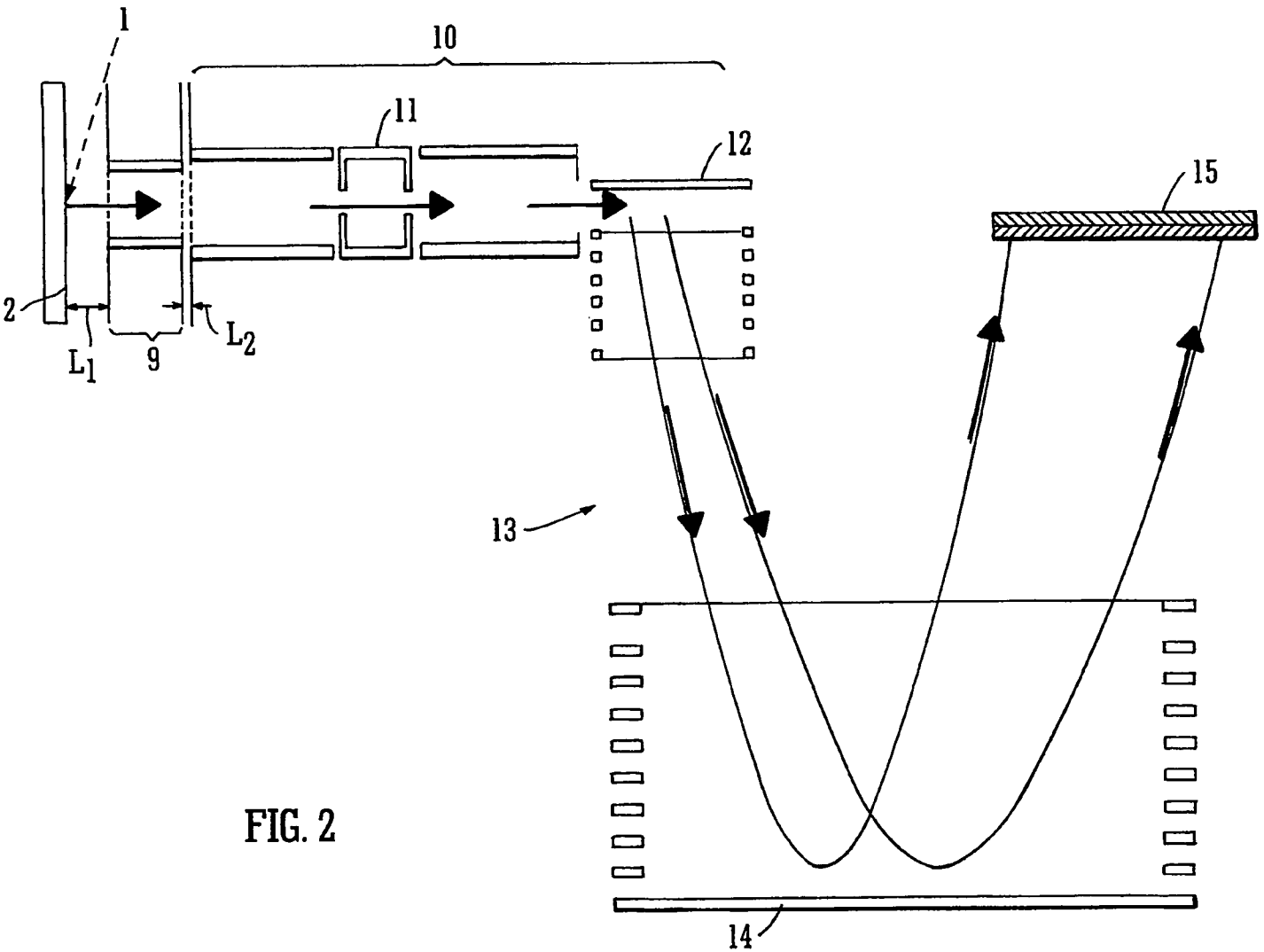
FIG. 2 shows a mass spectrometer according to an embodiment of the present invention comprising a MALDI ion source coupled to an orthogonal acceleration Time of Flight mass analyser wherein the mass spectrometer further comprises a first field free region and a second field free region and optionally a collision or fragmentation cell.

FIG. 2 shows a mass spectrometer according to an embodiment of the present invention. The mass spectrometer comprises a Matrix Assisted Laser Desorption Ionisation ("MALDI") ion source coupled to an orthogonal acceleration Time of Flight mass analyser 13. Ions are preferably generated, released or desorbed from a target or sample plate 2 forming part of the ion source. The ions then preferably pass through two separate electric field regions $L_1$, $L_2$. The electric field regions $L_1$, $L_2$ may be arranged within and/or downstream of the ion source.

The first electric field region $L_1$ is preferably arranged immediately adjacent to the target or sample plate 2. An electric field is preferably maintained across the first electric field region $L_1$ which preferably remains substantially constant with respect to time at least until preferably substantially all of the ions which have been generated pass through the first electric field region $L_1$. The electric field maintained across the first electric field region $L_1$ is preferably arranged so as to accelerate parent or precursor ions to a substantially constant energy. The parent or precursor ions are then preferably arranged to enter a first field free region 9 which is preferably arranged downstream of the first electric field region $L_1$.

A second electric field region $L_2$ is preferably arranged downstream of the first electric field region $L_1$. However, according to the preferred mode of operation an electric field is not actually maintained across the second electric field region $L_2$ although this is possible according to less preferred embodiments. A second field free region 10 is preferably provided downstream of the second electric field region $L_2$.

According to the preferred embodiment the first field free region 9, the second electric field region $L_2$ and the second field free region 10 may be considered as comprising a single field free region i.e. the potential of all ion-optical components in these regions 9, $L_2$, 10 is preferably maintained substantially the same.

The mass spectrometer preferably further comprises a mass filter (not shown) which is preferably arranged to select parent or precursor ions having a specific mass to charge ratio. The mass filter may comprise a magnetic sector mass filter, an RF quadrupole mass filter, a Wien filter or an orthogonal acceleration Time of Flight mass filter.

The mass filter may be provided upstream of the first field free region 9. Alternatively, the mass filter may more preferably be provided in the first field free region 9, or the second electric field region $L_2$ or the second field free region 10.

Time of flight mass selection may preferably be effected by timing the flight of ions from the target plate to an orthogonal extraction region (not shown) of an orthogonal acceleration Time of Flight mass filter. Only ions in the vicinity of the extraction region will be extracted or orthogonally accelerated when an extraction plate (not shown) arranged adjacent the extraction region is energised. The delay time to energise the extraction region is preferably proportional to the square root of the mass or mass to charge ratio of the parent or precursor ion. By default, the chosen parent or precursor ion and any associated fragment or daughter ions which travel at the same velocity will also be extracted for mass analysis in the orthogonal acceleration Time of Flight mass analyser which is preferably arranged further downstream.

A collision or fragmentation cell 11 or other collision, fragmentation or reaction device may optionally be provided within or as part of the second field free region 10 or elsewhere within the mass spectrometer. The collision or fragmentation cell 11 may be arranged such that in a mode of operation at least some of the ions passing through the second field free region 10 will be fragmented within the collision or fragmentation cell 11 into fragment or daughter ions. The resulting fragment or daughter ions will then preferably pass or continue through the remaining portion of the second field free region 10 at substantially the same velocity as their corresponding parent or precursor ions were travelling immediately prior to being fragmented.

According to an alternative embodiment, fragment or daughter ions may be formed by Post Source Decay ("PSD") wherein the laser 1 is operated at a power such that metastable parent or precursor ions are formed which spontaneously fragment into fragment or daughter ions after a short period of time. The fragment or daughter ions will continue to pass through the mass spectrometer at substantially the same velocity as their corresponding parent or precursor ions were travelling immediately prior to their spontaneous fragmentation. Accordingly, parent or precursor ions and any corresponding fragment or daughter ions will preferably arrive at the extraction or orthogonal acceleration region of the orthogonal acceleration Time of Flight mass analyser 13 at substantially the same time.

When ions arrive at the extraction or orthogonal acceleration region of the mass analyser 13, a pusher electrode 12 arranged preferably adjacent to the extraction or orthogonal acceleration region is preferably pulsed or otherwise energised in order to extract or orthogonally accelerate ions into the flight or drift region of the orthogonal acceleration Time of Flight mass analyser 13.

The orthogonal acceleration Time of Flight mass analyser 13 preferably includes an ion mirror or reflectron 14 for reflecting ions and an ion detector 15 for detecting ions. The reflectron or ion mirror 14 is preferably provided in order to increase the effective path length of the mass analyser 13 whilst maintaining orthogonal energy focusing. The ion detector 15 preferably comprises a microchannel plate ion detector although other types of ion detector may less preferably be employed.

Mass spectra are preferably generated using the time of flight data recorded by the ion detector 15. In one mode of operation the mass spectra may include parent or precursor ions and any corresponding fragment or daughter ions produced, for example, either by Post Source Decay or by Collisional Induced Dissociation due to fragmentation of parent or precursor ions within the collision or fragmentation cell 11 or other collision, fragmentation or reaction device.

After ions have been injected into the flight or drift region of the Time of Flight mass analyser 13, ions will arrive at the ion detector 15 at a time inversely proportional to the square root of the mass to charge ratio of the ion. A mass spectrum can then be produced which may include one or more parent or precursor ions and any corresponding fragment or daughter ions created or formed either by Post Source Decay ("PSD") of the corresponding parent or precursor ions and/or by Collision Induced Dissociation of corresponding parent or precursor ions in the collision or fragmentation cell 11. Fragment, daughter, product or adduct ions created by other mechanisms in a collision, fragmentation or reaction device may also be present.

The pusher electrode 12 is preferably energised when parent or precursor ions and/or any related fragment or daughter ions arrive at the orthogonal acceleration region adjacent the pusher electrode 12.

The effective orthogonal path or flight length Lx of ions according to the preferred embodiment is preferably arranged so as to comprise the length of the flight or drift region from the orthogonal acceleration region adjacent the pusher electrode 12 to the ion mirror 14, the effective path length within the ion mirror 14 and the path length from the ion mirror 14 to the ion detector 15. The ion detector 15 preferably has a length Ld and is limited in being only able to detect ions having mass to charge ratios within a particular mass to charge ratio range at any particular instrument setting. The range of mass to charge ratios of ions which can be detected at any particular instrument setting depends upon the axial energies of the ions and the orthogonal energy imparted to the ions.

According to the preferred embodiment, in order to produce a mass spectrum which includes fragment or daughter ions having a wide range of mass to charge ratios, the mass spectrometer is preferably operated at a number of different and subsequent instrument settings and mass spectral data and/or a separate mass spectrum is preferably obtained at each separate instrument setting.

According to the preferred embodiment the axial kinetic energy of fragment or daughter ions is preferably effectively progressively increased by operating the mass spectrometer at a number or series of different instrument settings. The axial kinetic energy of the parent or precursor ions is preferably progressively increased at each separate subsequent instrument setting. The parent or precursor ions which fragment preferably either by Collision Induced Dissociation or by Post Source Decay into a plurality of fragment or daughter ions are therefore preferably arranged to possess increasingly greater axial kinetic energies at each instrument setting. As a result same species of fragment or daughter ions which are formed at each subsequent instrument setting will preferably possess greater axial kinetic energies.

The parent or precursor ions are preferably arranged to fragment in either the first field free region 9 or the second field free region 10. According to the preferred embodiment the first and second field free regions 9,10 are preferably maintained at substantially the same potential at each instrument setting so that the first and second field free regions 9,10 act as or form a single field free region.

The kinetic energy of the parent or precursor ion depends upon the product of the ionic charge of the parent or precursor ion and the acceleration voltage applied between the target plate 2 and either the first field free region 9 and/or the second field free region 10 and/or the pusher electrode 12 in order to axially accelerate the ions. According to a less preferred embodiment the potential of the second field free region 10 and/or the pusher electrode 12 may be varied or increased at each instrument setting whilst the potential of the first field free region 9 may be kept constant at each instrument setting.

According to an embodiment the potential of the target plate 2 and/or the first field free region 9 and/or the potential of the second field free region 10 and/or the potential of the pusher electrode 12 may be kept constant, varied, increased or decreased at each instrument setting.

At any particular instrument setting ions having masses or mass to charge ratios between a low mass or mass to charge ratio Ml and a high mass or mass to charge ratio Mh can be arranged to be detected by the ion detector 15. The highest mass or mass to charge ratio ion Mh which may be detected by the ion detector 15 at any particular instrument setting can be considered as possessing an axial kinetic energy Eo.

According to the preferred embodiment the axial kinetic energy of the parent or precursor ions is preferably increased from one instrument setting to the next instrument setting. According to the preferred embodiment the parent or precursor ions are preferably arranged to possess an increased axial kinetic energy such that the energy of the parent or precursor ion preferably increases from an energy Eo to an energy Ep according to the following relationship:

$$Ep = \frac{MpEo}{Mh} \tag{3}$$

wherein Mp is the mass or mass to charge ratio of the parent or precursor ion, Ep is the axial energy of the parent or precursor ion (which will now not be detected by the ion detector at the new instrument setting since the parent or precursor ion will have too much kinetic energy and will therefore fly past the ion detector), Eo is the axial energy of the highest mass or mass to charge ratio ion which may be detected by the ion detector as the previous instrument setting and Mh is the highest mass or mass to charge ratio ion which may be detected at the new instrument setting.

If the axial energies of parent or precursor ions are increased at each new instrument setting then it will be apparent that the axial velocities of the parent or precursor ions will also be increased. Likewise, since the parent or precursor ions preferably fragment in a field free region then the axial velocities of the corresponding fragment or daughter ions will also be increased at the new instrument setting.

Therefore, the times of flight of ions from the sample target plate 2 through the first field free region 9 and through the second field free region 10 to reach the orthogonal acceleration region adjacent the pusher electrode 12 will be reduced. Accordingly, according to the preferred embodiment the delay time between a pulse of ions being generated and the pusher electrode 12 being energised in order to orthogonally accelerate ions into the flight or drift region of the mass analyser 13 is preferably correspondingly reduced at each subsequent new instrument setting.

The shortened delay time Tp at each new instrument setting between a pulse of ions being generated and the pusher electrode 12 being energised is preferably arranged to follow the following relationship:

$$Tp = To\sqrt{\frac{Mh}{Mp}} \tag{4}$$

wherein To is the time of flight of parent or precursor ions (having an axial energy of Eo when the mass spectrometer was operated at the previous instrument setting) to pass from the target plate 2 to the orthogonal acceleration region adjacent the pusher electrode 12, Mh is the highest mass or mass to charge ratio ion which may be detected at the new instrument setting and Mp is the mass to charge ratio of the parent or precursor ion.

By rearranging Equation 2 above the range of mass or mass to charge ratios of ions which can be detected by the ion detector at any particular instrument setting is given by:

$$\frac{Ml}{Mh} = \left(1 - \sqrt{\frac{Ex}{Eo}} \cdot \frac{Ld}{Lx}\right)^2 \tag{5}$$

wherein Ml is the lowest mass to charge ratio ion which can be detected at the particular instrument setting, Mh is the highest mass to charge ratio ion which can be detected at the particular instrument setting, Ex is the orthogonal energy imparted to ions after being orthogonally accelerated into the flight or drift region of the mass analyser, Eo is the maximum axial kinetic energy of an ion which can be detected by the ion detector at the particular instrument setting, Ld is the length or width of the ion detector and Lx is the effective orthogonal flight or path length of the mass analyser.

The above ratio of the minimum mass to charge ratio to the maximum mass to charge ratio of ions which can be detected by the ion detector 15 at any particular instrument setting is preferably a constant at any particular instrument setting since it is assumed that the orthogonal acceleration electric field and the length or width Ld of the ion detector 15 is kept constant.

According to the preferred embodiment multiple separate acquisitions are performed by operating the mass spectrometer at a number of separate instrument settings. One or more mass spectra or sets of mass spectral data are preferably obtained at each separate instrument setting. The various separate mass spectra or sets of mass spectral data are then preferably combined to form a final composite mass spectrum.

According to the preferred embodiment a final composite mass spectrum may be produced which includes fragment or daughter ions and which will have a significantly greater range of mass or mass to charge ratios compared to a mass spectrum which can produced using a conventional mass spectrometer.

In order to illustrate the preferred embodiment, a parent or precursor ion having a mass to charge ratio of M0 may be considered. The parent or precursor ion can be considered as fragmenting so as to produce a number of different fragment or daughter ions including five specific fragment or daughter ions having different mass to charge ratios. The five specific fragment or daughter ions can be considered as having mass to charge ratios of M1, M2, M3, M4 and M5 wherein M0>M1>M2>M3>M4>M5. For ease of illustration only, the mass to charge ratios of the parent or precursor ions and the five specific fragment or daughter ions can be considered as obeying the following relationship: M0/M1=M1/M2=M2/M3=M3/M4=M4/M5.

According to the illustrative example, the mass spectrometer may be arranged to operate at five separate and subsequent different instrument settings.

At the first instrument setting ions having mass to charge ratios within the range M0 to M1 may be detected and recorded by the ion detector 15. At the second instrument setting the ion detector 15 can detect and record ions having mass to charge ratios within the range M1 and M2. At the third instrument setting the ion detector 15 can detect and record ions having mass to charge ratios within the range M2 and M3. At the fourth instrument setting the ion detector 15 can detect and record ions having mass to charge ratios within the range M3 and M4. At the fifth instrument setting the ion detector 15 can detect and record ions having mass to charge ratios within the range M4 and M5.

At the first instrument setting parent or precursor ions having a mass to charge ratio MO are arranged to have or possess an axial kinetic energy E0.

At the second instrument setting the axial kinetic energy of the parent or precursor ions having a mass to charge ratio MO is preferably increased from an axial kinetic energy of E0 to a higher axial kinetic energy E1 according to the following relationship:

$$E1 = E0 \cdot \frac{MO}{M1} \tag{6}$$

wherein E0 is the axial kinetic energy of the parent or precursor ions at the first instrument setting, E1 is the increased axial kinetic energy of the parent or precursor ions at the second instrument setting, M0 is the mass to charge ratio of the parent or precursor ion and M1 is the mass to charge ratio of the first specific fragment or daughter ion.

In order to activate or energise the pusher electrode 12 at the correct time, the pusher electrode delay time T1 at the second instrument setting is preferably arranged to be less than the pusher electrode delay time T0 at the first instrument setting. The two delay times are preferably related according to:

$$T1 = T0\sqrt{\frac{M1}{M0}} \tag{7}$$

wherein T1 is the pusher delay time at the second instrument setting, T0 is the pusher delay time at the first instrument setting, M1 is the mass to charge ratio of the first specific fragment or daughter ion and M0 is the mass to charge ratio of the parent or precursor ion.

Generally, in order to produce a mass spectrum incorporating ions having mass to charge ratios between M0 (the mass to charge ratio of the parent or precursor ion) and $M_n$ (wherein $M_n$ is the lowest mass or mass to charge ratio fragment or daughter ion) and wherein the ratio $M_{n-1}/M_n$ is constant at each instrument setting then the mass spectrometer should preferably be arranged to be operated at n separate and subsequent instrument settings.

At each instrument setting n, the parent or precursor axial ion energy is preferably set to $E_{n-1}$ and the pusher electrode delay time is preferably set to $T_{n-1}$ wherein:

$$E_{n-1} = E0 \cdot \frac{M0}{M_{n-1}} \tag{8}$$

and:

$$T_{n-1} = T0 \cdot \sqrt{\frac{M_{n-1}}{M0}} \tag{9}$$

wherein $E_{n-1}$ is the axial kinetic energy of the parent or precursor ion at the nth instrument setting, E0 is the axial kinetic energy of the parent or precursor ion at the first instrument setting, MO is the mass to charge ratio of the parent or precursor ion, $M_{n-1}$ is the highest mass to charge ratio ion which may be detected at the nth instrument setting, $M_n$ is the lowest mass to charge ratio ion which may be detected at the nth instrument setting, T0 is the pusher electrode delay time at the first instrument setting and $T_{n-1}$ is the pusher electrode delay time at the nth instrument setting.

At each separate instrument setting mass spectral data is preferably acquired and a mass spectrum may optionally be produced.

At each instrument setting the laser 1 may be fired repeatedly so that a mass spectrum or a set of mass spectral data may be built up or acquired from multiple acquisitions at the same instrument setting.

The mass spectra or mass spectral data recorded at each of the different and subsequent instrument settings may then preferably be added together or at least overlapped so as to produce a final composite mass spectrum which preferably covers a wide range of mass to charge ratios.

The final composite mass spectrum may be formed by combining the various separate mass spectra or mass spectral data sets acquired at each of the different and subsequent instrument settings since the calibration of the orthogonal acceleration Time of Flight mass analyser is preferably substantially independent of the axial energies of the ions when they are orthogonally accelerated into the orthogonal acceleration region of the mass analyser 13.

By modifying (e.g. increasing) the axial ion energies En of the parent or precursor ions at each subsequent instrument setting and by modifying (e.g. shortening or reducing) the pusher electrode delay time Tn between generating ions and subsequently energising the pusher electrode 12 at each subsequent instrument setting and by also acquiring mass spectral data at each instrument setting, the yield and transmission efficiency of low mass to charge ratio fragment or daughter ions can be substantially enhanced compared to conventional arrangements.

A further advantage of the preferred embodiment is that by effectively increasing the axial kinetic energy of fragment or daughter ions at each subsequent instrument setting, the fragment or daughter ions become less sensitive to unwanted surface charge effects. Another advantage of increasing the kinetic energy at each subsequent instrument setting is that the solid divergence angle of the fragment or daughter ions is reduced.

The preferred embodiment preferably enables a substantial increase in ion transmission to be achieved through various fixed apertures present within the mass spectrometer.

According to a less preferred embodiment the axial energies of the parent or precursor ions may be reduced at each instrument setting and the pusher electrode delay time may be increased at each instrument setting.

It is also contemplated that the axial energy of the parent or precursor ions and/or the pusher electrode delay time may be varied in a non-progressive, non-linear or even random manner.

According to a less preferred embodiment instead of altering or increasing the axial energy of the parent or precursor ions at subsequent instrument settings, the orthogonal energy imparted to the ions in the orthogonal acceleration region at each instrument setting may be varied by altering or changing the voltage or potential applied to the pusher electrode 12 at each instrument setting.

According to this embodiment the orthogonal energy $Ex_n$ imparted to ions at an nth instrument setting is preferably related to the orthogonal energy Ex imparted to ions at a previous instrument setting according to the relationship:

$$Ex_{n-1} = Ex \cdot \frac{M_{n-1}}{M0} \tag{10}$$

wherein $Ex_n$ is the orthogonal energy imparted to ions at a nth instrument setting, Ex is the orthogonal energy imparted to ions at a first or original instrument setting, $M_{n-1}$ is the highest mass to charge ratio ion which may be detected at the nth instrument setting, $M_n$ is the lowest mass to charge ratio ion which may be detected by the ion detector at the nth instrument setting and MO is the mass to charge ratio of the parent or precursor ion.

According to this less preferred embodiment the delay time between generating ions and energising the pusher electrode 12 may be kept substantially constant from one instrument setting to the next. Further improvements to this less preferred embodiment are contemplated by also modifying the voltages applied to either the electrodes forming the flight or drift region of the mass analyser 13 and/or the electrodes of the ion mirror or reflectron 14 so as to ensure that spatial time focusing is also achieved at the ion detector 15.

According to an embodiment of the present invention the orthogonal energy imparted to ions may be altered in subsequent instrument settings by varying the voltage applied to the pusher electrode 12. The axial ion energy of the parent or precursor ions may also be varied, increased or decreased at subsequent instrument settings. The pusher electrode delay time between generating ions and energising the pusher electrode 15 may also be varied, decreased or increased at subsequent instrument settings.

Figure 3:
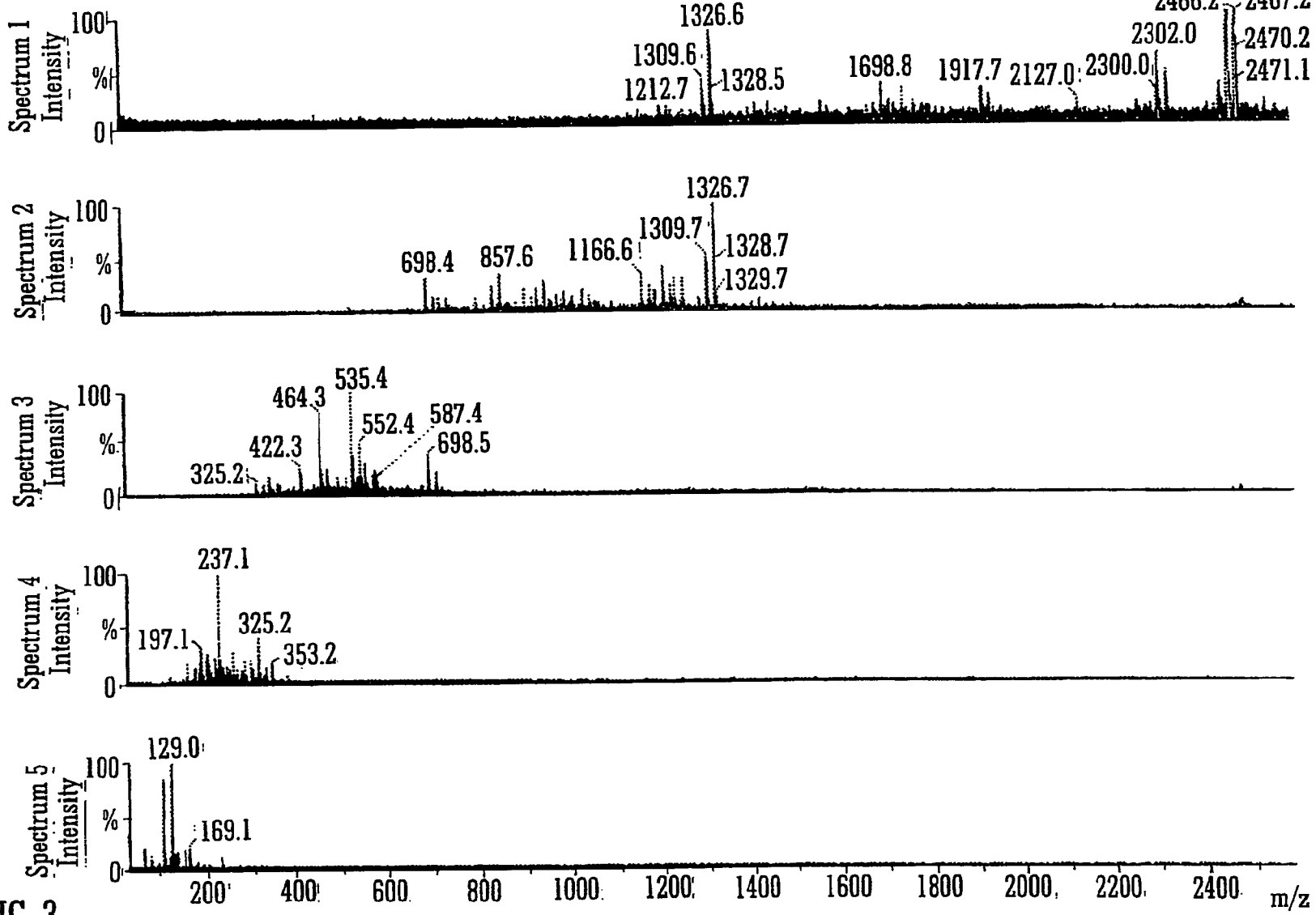
FIG. 3 shows five mass spectra acquired according to an embodiment of the present invention by progressively increasing the axial energy of parent or precursor ions at subsequent instrument settings and by progressively reducing the delay time between a pulse of ions being generated and the pusher electrode of the Time of Flight mass analyser being energised in order to orthogonally accelerate ions into the flight or drift region of the mass analyser.

Some experimental results obtained according to an embodiment of the present invention are shown in FIG. 3. FIG. 3 shows five mass spectra which were produced or obtained from mass spectral data which was acquired or obtained at five separate instrument settings. The mass spectral data was acquired or obtained using a mass spectrometer comprising a MALDI ion source coupled to an orthogonal acceleration Time of Flight mass analyser. The mass spectrometer was substantially similar to the mass spectrometer shown in FIG. 2.

A peptide sample of ACTH (MH+2465.2) was used in order to obtain the experimental data. ACTH peptide ions were arranged to dissociate by Post Source Decay ("PSD") between the MALDI sample plate and the orthogonal acceleration region of the Time of Flight mass analyser.

At the first instrument setting which corresponds to the first mass spectrum shown in FIG. 3, the parent or precursor ions were arranged to have an axial energy of 275 eV. The delay time between generating a pulse of ions and energising the pusher electrode in order to orthogonally accelerate the ions was set at 54.7 μs. At the first instrument setting the maximum mass to charge ratio of ions of interest was set at 2465 Da.

At the second instrument setting which corresponds to the second mass spectrum shown in FIG. 3, the parent or precursor ions were arranged to have an axial energy of 511 eV. The delay time between generating a pulse of ions and energising the pusher electrode in order to orthogonally accelerate the ions was set at 40.0 μs. At the second instrument setting the maximum mass to charge ratio of ions of interest was set at 1327 Da.

At the third instrument setting which corresponds to the third mass spectrum shown in FIG. 3, the parent or precursor ions were arranged to have an axial energy of 972 eV. The delay time between generating a pulse of ions and energising the pusher electrode in order to orthogonally accelerate the ions was set at 28.8 μs. At the third instrument setting the maximum mass to charge ratio of ions of interest was set at 698 Da.

At the fourth instrument setting which corresponds to the fourth mass spectrum shown in FIG. 3, the parent or precursor ions were arranged to have an axial energy of 2085 eV. The delay time between generating a pulse of ions and energising the pusher electrode in order to orthogonally accelerate the ions was set at 19.4 μs. At the fourth instrument setting the maximum mass to charge ratio of ions of interest was set at 325 Da.

At the fifth instrument setting which corresponds to the fifth mass spectrum shown in FIG. 3, the parent or precursor ions were arranged to have an axial energy of 4000 eV. The delay time between generating a pulse of ions and energising the pusher electrode in order to orthogonally accelerate the ions was set at 13.7 μs. At the fifth instrument setting the maximum mass to charge ratio of ions of interest was set at 169 Da.

According to this particular example the orthogonal energy Ex imparted to ions at each of the separate and subsequent instrument settings was kept substantially constant at 9500 eV. The effective orthogonal flight or path length Lx was 0.8 m and the length of the ion detector Ld was 40 cm.

FIG. 3 shows the five separate mass spectra which were acquired at the five separate and subsequent instrument settings. The axial energies of the parent or precursor ions and the corresponding delay times between generating the ions and energising the pusher electrode for each instrument setting were set by generally following equations 8 and 9 as given above.

In this particular illustrative example the ratio of the highest mass to charge ratio ion Mh to the lowest mass to charge ratio ion Ml which were detected by the ion detector at each instrument setting was arranged so as to be approximately 2.1.

The precise ratios of the increase in the axial energy of the parent or precursor ions and the decrease in the pusher electrode delay time varied slightly from instrument setting to instrument setting but in general this ratio was generally arranged to be less than 2.1 in order to allow for there to be some degree of overlap between the mass spectral data obtained or acquired at each instrument setting. This made it easier to combine the mass spectral data or mass spectrum acquired at each of the separate instrument settings so as to form a final composite mass spectrum.

It can be seen from the second, third, fourth and fifth mass spectra shown in FIG. 3 that progressively lower mass or mass to charge fragment or daughter ions were observed at each subsequent instrument setting as the axial energy of the parent or precursor ions was increased and the pusher electrode delay time was reduced according to the preferred embodiment.

Although the present invention has been described with reference to the preferred embodiments, it will be understood by those skilled in the art that various changes in form and detail may be made without departing from the scope of the invention as set forth in the accompanying claims.

The invention claimed is:

1. A method of mass spectrometry comprising:

providing an orthogonal acceleration Time of Flight mass analyser comprising an orthogonal acceleration region;

providing a first packet or group of parent or precursor ions;

accelerating said first packet or group of parent or precursor ions with a first potential so that said first packet or group of parent or precursor ions possess a first axial energy;

fragmenting said first packet or group of parent or precursor ions into a first plurality of fragment or daughter ions or allowing said first packet or group of parent or precursor ions to fragment into a first plurality of fragment or daughter ions;

orthogonally accelerating at least some of said first plurality of fragment or daughter ions after a first delay time;

detecting fragment or daughter ions of said first plurality of fragment or daughter ions having a first range of axial energies;

generating first mass spectral data relating to fragment or daughter ions of said first plurality of fragment or daughter ions having said first range of axial energies;

providing a second packet or group of parent or precursor ions;

accelerating said second packet or group of parent or precursor ions with a second potential different from the first potential so that said second packet or group of parent or precursor ions possess a second axial energy different from said first axial energy;

fragmenting said second packet or group of parent or precursor ions into a second plurality of fragment or daughter ions or allowing said second packet or group of parent or precursor ions to fragment into a second plurality of fragment or daughter ions;

orthogonally accelerating at least some of said second plurality of fragment or daughter ions after a second delay time;

detecting fragment or daughter ions of said second plurality of fragment or daughter ions having a second range of axial energies;

generating second mass spectral data relating to said fragment or daughter ions of said second plurality of fragment or daughter ions having said second range of axial energies; and forming a composite mass spectrum by using, combining or overlapping said first mass spectral data and said second mass spectral data.

2. A method as claimed in claim 1, wherein said first delay time is substantially different to said second delay time.

3. A method as claimed in claim 1, further comprising providing a first electric field region.

4. A method as claimed in claim 3, further comprising providing a first field free region.

5. A method as claimed in claim 4, wherein said first field free region is arranged downstream of said first electric field region.

6. A method as claimed in claim 5, further comprising providing a second electric field region.

7. A method as claimed in claim 6, further comprising providing a second field free region.

8. A method as claimed in claim 7, wherein said second field free region is arranged downstream of said second electric field region.

9. A method as claimed in claim 8, further comprising providing one or more electrodes arranged adjacent said orthogonal acceleration region.

10. A method as claimed in claim 9, wherein said step of accelerating said first packet or group of parent or precursor ions comprises maintaining said one or more electrodes at a first potential and wherein said step of accelerating said second packet or group of parent or precursor ions comprises maintaining said one or more electrodes at a second potential.

11. A method as claimed in claim 10, wherein said second potential differs from said first potential by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

12. A method as claimed in claim 1, further comprising:

providing a third packet or group of parent or precursor ions;

accelerating said third packet or group of parent or precursor ions so that said third packet or group of parent or precursor ions possess a third different axial energy;

fragmenting said third packet or group of parent or precursor ions into a third plurality of fragment or daughter ions or allowing said third packet or group of parent or precursor ions to fragment into a third plurality of fragment or daughter ions;

orthogonally accelerating at least some of said third plurality of fragment or daughter ions after a third delay time;

detecting fragment or daughter ions of said third plurality of fragment or daughter ions having a third range of axial energies; and generating third mass spectral data relating to fragment of daughter ions of said third plurality of fragment or daughter ions having said third range of axial energies.

13. A method as claimed in claim 12, wherein said first, second and third ranges of axial energies are substantially the same.

14. A method as claimed in claim 12, wherein said first, second and third delay times are substantially different.

15. A method as claimed in claim 12, wherein said step of accelerating said third packet or group of parent or precursor ions comprises maintaining said one or more electrodes at a third potential.

16. A method as claimed in claim 15, wherein said third potential differs from said first or second potential by at least 1%, 5%, 10%, 20%, 30%, 40%, 50%, 60%, 70%, 80%, 90%, 100%, 110%, 120%, 130%, 140%, 150%, 160%, 170%, 180%, 190%, 200%, 210%, 220%, 230%, 240%, 250%, 260%, 270%, 280%, 290%, 300%, 350%, 400%, 450% or 500%.

17. A method as claimed in claim 12, wherein said step of forming a composite mass spectrum further comprises using, combining or overlapping said first mass spectral data, said second mass spectral data and said third mass spectral data.

18. A method as claimed in claim 1, further comprising providing a collision, fragmentation or reaction device.

19. A method as claimed in claim 18, wherein said collision, fragmentation or reaction device is arranged to fragment ions by Collisional Induced Dissociation ("CID").

20. A method as claimed in claim 1, wherein said step of allowing ions to fragment comprises allowing ions to fragment by Post Source Decay ("PSD").

21. A method as claimed in claim 1, further comprising providing an electrostatic energy analyser or a mass filter or an ion gate for selecting specific parent or precursor ions.

22. A method as claimed in claim 21, wherein said mass filter comprises a magnetic sector mass filter, an RF quadrupole mass filter, a Wien filter or an orthogonal acceleration Time of Flight mass filter.

23. A method as claimed in claim 1, wherein said first range of axial energies is substantially different from said second range of axial energies.

24. A mass spectrometer comprising:

an orthogonal acceleration Time of Flight mass analyser comprising an orthogonal acceleration region;

a control system which is arranged to:

(i) accelerate a first packet or group of parent or precursor ions with a first potential so that said first packet or group of parent or precursor ions possesses a first axial energy;

(ii) fragment said first packet or group of parent or precursor ions into a first plurality of fragment or daughter ions or allow said first packet or group of parent or precursor ions to fragment into a first plurality of fragment or daughter ions;

(iii) orthogonally accelerate at least some of said first plurality of fragment or daughter ions after a first delay time;

(iv) accelerate a second packet or group of parent or precursor ions with a second potential different from the first potential so that said second packet or group of parent or precursor ions possesses a second axial energy different from said first axial energy;

(v) fragment said second packet or group of parent or precursor ions into a second plurality of fragment or daughter ions or allowing said second packet or group of parent or precursor ions to fragment into a second plurality of fragment or daughter ions; and (vi) orthogonally accelerate at least some of said second plurality of fragment or daughter ions after a second delay time;

an ion detector which is arranged to:

(i) detect fragment or daughter ions of said first plurality of fragment or daughter ions having a first range of axial energies;

(ii) detect fragment or daughter ions of said second plurality of fragment or daughter ions having a second range of axial energies;

said mass spectrometer further comprising:

means arranged to generate first mass spectral data relating to fragment or daughter ions of said first plurality of fragment or daughter ions having said first range of axial energies;

means arranged to generate second mass spectral data relating to said fragment or daughter ions of said second plurality of fragment or daughter ions having said second range of axial energies; and means arranged to form a composite mass spectrum by using, combining or overlapping said first mass spectral data and said second mass spectral data.

25. A mass spectrometer as claimed in claim 24, further comprising an ion source selected from the group consisting of: (i) an Electrospray ionisation ("EST") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

26. A mass spectrometer as claimed in claim 24, further comprising a collision, fragmentation or reaction device.

27. A mass spectrometer as claimed in claim 26, wherein at least some parent or precursor ions are fragmented or reacted in use in said collision, fragmentation or reaction device to form fragment, daughter, adduct or product ions and wherein said fragment, daughter, adduct or product ions exit said collision, fragmentation or reaction device with substantially the same velocity and reach said orthogonal acceleration region at substantially the same time.

28. A mass spectrometer as claimed in claim 24, wherein said first range of axial energies is substantially different from said second range of axial energies.

29. A method of mass spectrometry comprising:

providing an orthogonal acceleration Time of Flight mass analyser comprising an orthogonal acceleration region;

providing a first packet or group of parent or precursor ions;

fragmenting said first packet or group of parent or precursor ions into a first plurality of fragment or daughter ions or allowing said first packet or group of parent or precursor ions to fragment into a first plurality of fragment or daughter ions;

orthogonally accelerating at least some of said first plurality of fragment or daughter ions with a first potential so that said at least some of said first plurality of fragment or daughter ions possess a first orthogonal energy;

detecting fragment or daughter ions of said first plurality of fragment or daughter ions having said first orthogonal energy;

generating first mass spectral data relating to fragment or daughter ions of said first plurality of fragment or daughter ions having said first orthogonal energy;

providing a second packet or group of parent or precursor ions;

fragmenting said second packet or group of parent or precursor ions into a second plurality of fragment or daughter ions or allowing said second packet or group of parent or precursor ions to fragment into a second plurality of fragment or daughter ions;

orthogonally accelerating at least some of said second plurality of fragment or daughter ions with a second potential different from the first potential so that said at least some of said second plurality of fragment or daughter ions possess a second orthogonal energy different from said first orthogonal energy;

detecting fragment or daughter ions of said second plurality of fragment or daughter ions having said second orthogonal energy;

generating second mass spectral data relating to said fragment or daughter ions of said second plurality of fragment or daughter ions having said second orthogonal energy; and forming a composite mass spectrum by using, combining or overlapping said first mass spectral data and said second mass spectral data.

30. A method as claimed in claim 29, wherein said first orthogonal energy is selected from the group consisting of: (i) <1.0 keV; (ii) 1.0-1.5 keV; (iii) 1.5-2.0 keV; (iv) 2.0-2.5 keV; (v) 2.5-3.0 keV; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 key; (xv) 7.5-8.0 keV; (xvi) 8.0-8.5 keV; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 key; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 key; (xxxviii) 19.0-19.5 keV; (xxxix) 19.5-20.0 keV; (xl) >20 keV.

31. A method as claimed in claim 30, wherein said second orthogonal energy is selected from the group consisting of: (i) <1.0 keV; (ii) 1.0-1.5 key; (iii) 1.5-2.0 keV; (iv) 2.0-2.5 keV; (v) 2.5-3.0 key; (vi) 3.0-3.5 keV; (vii) 3.5-4.0 keV; (viii) 4.0-4.5 keV; (ix) 4.5-5.0 keV; (x) 5.0-5.5 keV; (xi) 5.5-6.0 keV; (xii) 6.0-6.5 keV; (xiii) 6.5-7.0 keV; (xiv) 7.0-7.5 keV; (xv) 7.5-8.0 keV; (xvi) 8.0-8.5 key; (xvii) 8.5-9.0 keV; (xviii) 9.0-9.5 keV; (xix) 9.5-10.0 keV; (xx) 10.0-10.5 keV; (xxi) 10.5-11.0 keV; (xxii) 11.0-11.5 keV; (xxiii) 11.5-12.0 keV; (xxiv) 12.0-12.5 keV; (xxv) 12.5-13.0 keV; (xxvi) 13.0-13.5 keV; (xxvii) 13.5-14.0 keV; (xxviii) 14.0-14.5 keV; (xxix) 14.5-15.0 keV; (xxx) 15.0-15.5 keV; (xxxi) 15.5-16.0 keV; (xxxii) 16.0-16.5 keV; (xxxiii) 16.5-17.0 keV; (xxxiv) 17.0-17.5 keV; (xxxv) 17.5-18.0 keV; (xxxvi) 18.0-18.5 keV; (xxxvii) 18.5-19.0 keV; (xxxviii) 19.0-19.5 keV; (xxxix) 19.5-20.0 keV; (xl) >20 keV.

32. A method as claimed in claim 29, wherein orthogonally accelerating at least some of said first plurality of fragment or daughter ions includes applying a first voltage and orthogonally accelerating at least some of said second plurality of fragment or daughter ions includes applying a second voltage different from the first voltage so as to cause said at least some of said second plurality of fragment or daughter ions possess said second orthogonal energy different from said first orthogonal energy.

33. A mass spectrometer comprising:

an orthogonal acceleration Time of Flight mass analyser comprising an orthogonal acceleration region;

a control system which is arranged to:

(i) fragment a first packet or group of parent or precursor ions into a first plurality of fragment or daughter ions or allow said first packet or group of parent or precursor ions to fragment into a first plurality of fragment or daughter ions;

(ii) orthogonally accelerate at least some of said first plurality of fragment or daughter ions with a first potential so that said at least some of said first plurality of fragment or daughter ions possess a first orthogonal energy;

(iii) fragment a second packet or group of parent or precursor ions into a second plurality of fragment or daughter ions or allow said second packet or group of parent or precursor ions to fragment into a second plurality of fragment or daughter ions; and (iv) orthogonally accelerate at least some of said second plurality of fragment or daughter ions with a second potential different from the first potential so that said at least some of said second plurality of fragment or daughter ions possess a second orthogonal energy different from said first orthogonal energy;

an ion detector which is arranged to:

(i) detect fragment or daughter ions of said first plurality of fragment or daughter ions having said first orthogonal energy;

(ii) detect fragment or daughter ions of said second plurality of fragment or daughter ions having said second orthogonal energy;

said mass spectrometer further comprising:

means arranged to generate first mass spectral data relating to fragment or daughter ions of said first plurality of fragment or daughter ions having said first orthogonal energy;

means arranged to generate second mass spectral data relating to said fragment or daughter ions of said second plurality of fragment or daughter ions having said second orthogonal energy; and means arranged to form a composite mass spectrum by using, combining or overlapping said first mass spectral data and said second mass spectral data.

34. A mass spectrometer as claimed in claim 33, wherein the control system is further configured to orthogonally accelerate at least some of said first plurality of fragment or daughter ions by applying a first voltage and orthogonally accelerate at least some of said second plurality of fragment or daughter ions by applying a second voltage different from the first voltage so as to cause said at least some of said second plurality of fragment or daughter ions possess said second orthogonal energy different from said first orthogonal energy.

* * * * *

UNITED STATES PATENT AND TRADEMARK OFFICE

CERTIFICATE OF CORRECTION

PATENT NO. : 8,507,849 B2
APPLICATION NO. : 11/721755
DATED : August 13, 2013
INVENTOR(S) : Brown It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1672 days.

Signed and Sealed this
Tenth Day of February, 2015

Michelle K. Lee

Michelle K. Lee
*Deputy Director of the United States Patent and Trademark Office*